US009187231B1

(12) United States Patent
Burtner et al.

(10) Patent No.: US 9,187,231 B1
(45) Date of Patent: Nov. 17, 2015

(54) PORTABLE BEVERAGE ASSEMBLY AND MIXING KIT

(71) Applicants: William Peter Burtner, Vista, CA (US); Douglas Milton Burtner, San Jose, CA (US)

(72) Inventors: William Peter Burtner, Vista, CA (US); Douglas Milton Burtner, San Jose, CA (US)

(73) Assignee: William Peter Burtner, Vista, CA (US)

( * ) Notice: Subject to any disclaimer, the term of this patent is extended or adjusted under 35 U.S.C. 154(b) by 0 days.

(21) Appl. No.: 13/847,997

(22) Filed: Mar. 20, 2013

(51) Int. Cl.
*B65D 81/32* (2006.01)

(52) U.S. Cl.
CPC ..... *B65D 81/3222* (2013.01)

(58) Field of Classification Search
CPC ..... B65D 81/32
USPC ..... 206/217, 219, 427, 426; 426/106, 112, 426/115, 132, 119, 120, 86; 222/538
See application file for complete search history.

(56) References Cited

U.S. PATENT DOCUMENTS 740,446 A * 10/1903 Lattard et al. ..... 220/568
1,075,119 A * 10/1913 Reichner ..... 99/508
1,931,032 A * 10/1933 Panfil ..... 222/539
3,469,739 A * 9/1969 Phillips ..... 221/96
4,603,784 A * 8/1986 Chang ..... 215/11.1
4,934,525 A * 6/1990 Robinson ..... 206/217
5,114,011 A * 5/1992 Robbins, III ..... 206/499
5,301,833 A * 4/1994 Aycan ..... 221/96
5,662,249 A * 9/1997 Grosse ..... 222/461
8,051,996 B1 * 11/2011 Amaya et al. ..... 215/6
2008/0023348 A1 * 1/2008 Herzog et al. ..... 206/217
2008/0099364 A1 * 5/2008 Niedzwiecki ..... 206/517
2008/0128378 A1 * 6/2008 Nowzari ..... 215/6

OTHER PUBLICATIONS

"The Bruhaus" ("Top 20 Tasting Tips"), pub. online Jan. 7, 2009. http://web.archive.org/web/20090107093221/http://www.thebruhaus.com/Pages/SecondaryPages/tastingtips.html.*
"Amazon" ("Reliance Products Desert Patrol 6 Gallon Traditional Jeep Style Rigid Water Container"), comments by Bill pub. online Jul. 17, 2010. http://www.amazon.com/Reliance-Products-Desert-Traditional-Container/dp/B0002IW6IY.*
"Yanko Design" ("Glass Half Full . . . Always"), pub. online Dec. 2, 2009. http://web.archive.org/web/20091202101634/http://www.yankodesign.com/2009/11/30/glass-half-full-always/.*

* cited by examiner

*Primary Examiner* — Preston Smith
(74) *Attorney, Agent, or Firm* — Michael D. Eisenberg

(57) ABSTRACT

The present invention relates to a portable beverage assembly kit having a serving container and beverage ingredients, for fast distribution to an end user, the components necessary to construct a beverage and container for serving therein, comprising: a disassembled beverage container configured for drinking directly therefrom; and a shaker configured to store within the shaker the disassembled beverage container within a first compartment and the beverage ingredients within a second compartment, separate from the first compartment.

12 Claims, 4 Drawing Sheets

PORTABLE BEVERAGE ASSEMBLY AND MIXING KIT

TECHNICAL FIELD

The present invention, in some embodiments thereof, relates to devices for transporting, serving and preparing mixed beverages.

BACKGROUND OF THE INVENTION

Many beverages require the selection and mixing of two or more liquid ingredients. For example, many alcoholic beverages call for several ingredients. One could serve pre-mixed drinks, but this would result in stale beverages. Thus, many venues opt to mix the beverages at the time of purchase. This creates a bottleneck when serving masses of people, for example, at a sporting event. It would therefore be advantageous to have to a device and system that relieves this bottleneck by eliminating the need for the server to the mix the beverages, and instead allow the end user to accomplish this task. The present invention address this need and others.

BRIEF SUMMARY OF EMBODIMENTS OF THE INVENTION (1) The present invention relates to a portable beverage assembly kit having a serving container and beverage ingredients, for fast distribution to an end user, the components necessary to construct a beverage and container for serving therein, comprising: a disassembled beverage container configured for drinking directly therefrom; and a shaker configured to store within the shaker the disassembled beverage container within a first compartment and the beverage ingredients within a second compartment, separate from the first compartment.

(2) In a variant of the portable beverage assembly kit, the first compartment comprises a dry compartment and the second compartment comprises a fluid filled compartment containing the beverage ingredients.

(3) In another variant, of the portable beverage assembly kit, the dry compartment is shaped to conform to the general shape of the beverage container.

(4) In a further variant, the portable beverage assembly kit comprises: a lid having two sides; and a pour spout disposed on one side of the lid, the pour spout having a through hole permitting transfer of liquid through the lid.

(5) In still another variant, the portable beverage assembly kit comprises a cap, and wherein the pour spout is configured to receive the cap.

(6) In yet another variant of the portable beverage assembly kit, the lid is removeably attachable to the shaker on both sides of the lid.

(7) In a variant, the shaker comprises a disassembled shaker, comprising: a pour spout detachable from the shaker; an end of the shaker configured to connect to the pour spout in a manner that orients the pour spout in an inward facing direction inside of the shaker; and an opening of the shaker leading to a fluid container is configured to connect to the pour spout in a manner that orients the pour spout in an outward facing direction outside of the shaker.

(8) In another variant, a portable beverage assembly kit having a serving container and beverage ingredients, for fast distribution to an end user of the components necessary to construct a beverage and container for serving therein, comprises: a beverage container; and a shaker configured to store within the shaker the beverage container and the beverage ingredients within two separate compartments; a lid for the shaker connected to the compartment storing the beverage container, having a pour spout oriented to an interior of the shaker when the kit is in a transport configuration, and connected to the compartment storing the beverage ingredients when the kit is assembled in a use configuration; wherein walls of the compartment storing beverage container conforms generally to the shape of the beverage container; wherein the compartment storing the beverage ingredients is liquid tight when sealed with a cap.

(9) In a further variant, the beverage container is a disassembled beverage container configured for drinking directly therefrom, comprising: a base; and a cup portion.

(10) In yet another variant of the portable beverage assembly kit, the beverage container is a traditional martini glass.

(11) In still a further variant of the portable beverage assembly kit, removeable caps are configured to secure enclose ends of the shaker.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
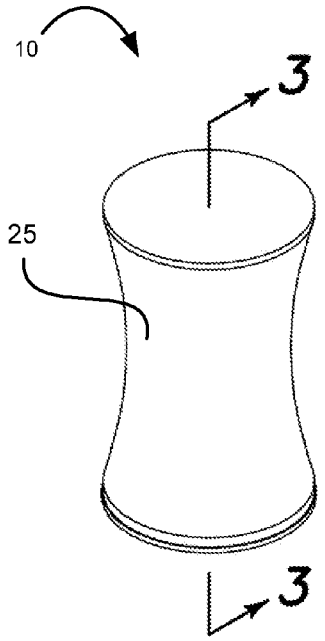
FIG. 1 is a perspective view of the portable beverage assembly and mixing kit in accordance with the principles of the invention.
Figure 2:
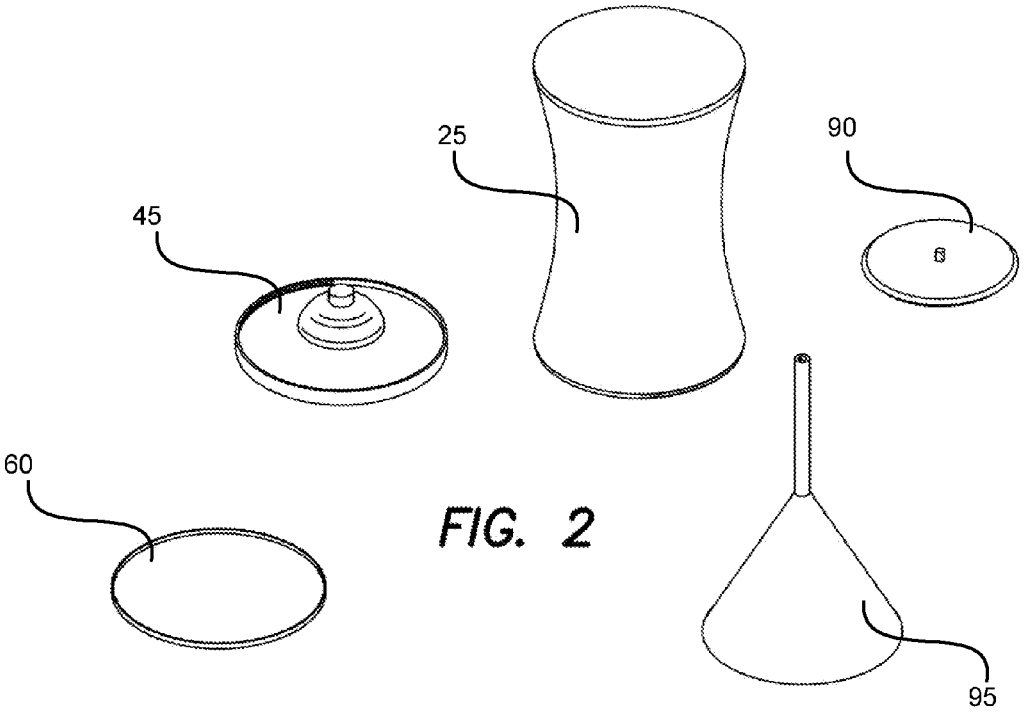
FIG. 2 is a perspective view of the beverage assembly and mixing kit with a disassembled beverage container and cap removed from the shaker.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The following reference numerals are used throughout this document:

The present invention, in some embodiments thereof, relates to a portable beverage assembly kit 10, for fast distribution to an end user. Referring to FIGS. 1-6, the kit has a beverage serving container 15 and beverage ingredients 35, which are the components necessary to construct a beverage and container for serving same.

(1) In a variant, the kit comprises a disassembled beverage container 15 configured for drinking directly therefrom. The kit has a shaker 25 configured to store within the shaker the disassembled beverage container 15 within a first compartment 30 and the beverage ingredients 35 within a second compartment 40, separate from the first compartment 30.

(2) In a variant of the portable beverage assembly kit, the first compartment 30 comprises a dry compartment and the second compartment 40 comprises a fluid filled compartment containing the beverage ingredients 35.

(3) In another variant, of the portable beverage assembly kit, the dry compartment 30 is shaped to conform to the general shape of the beverage container.

Figure 3:
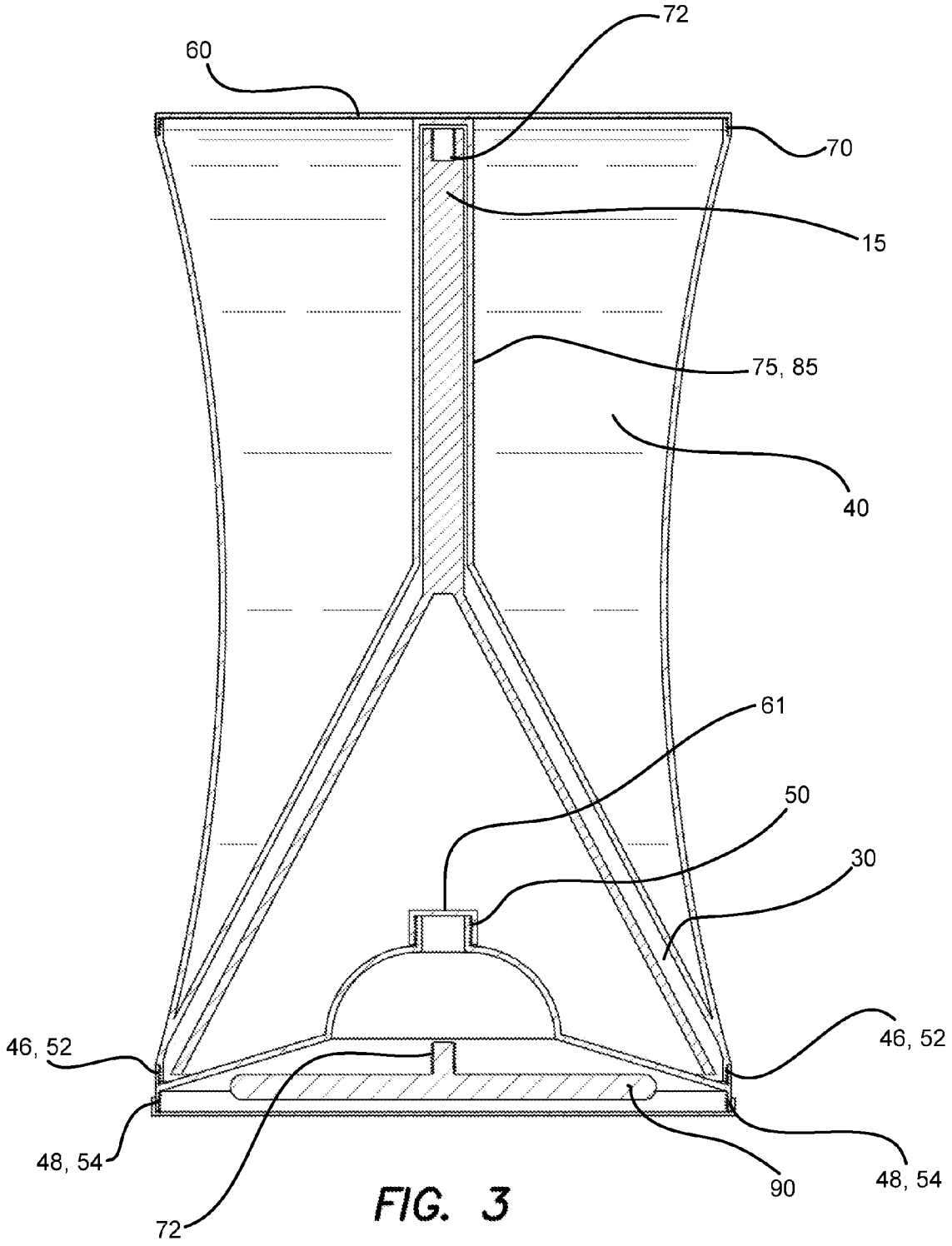
FIG. 3 is a cross sectional view through the line 3-3 in FIG. 1, of the beverage assembly and mixing kit.
Figure 4:
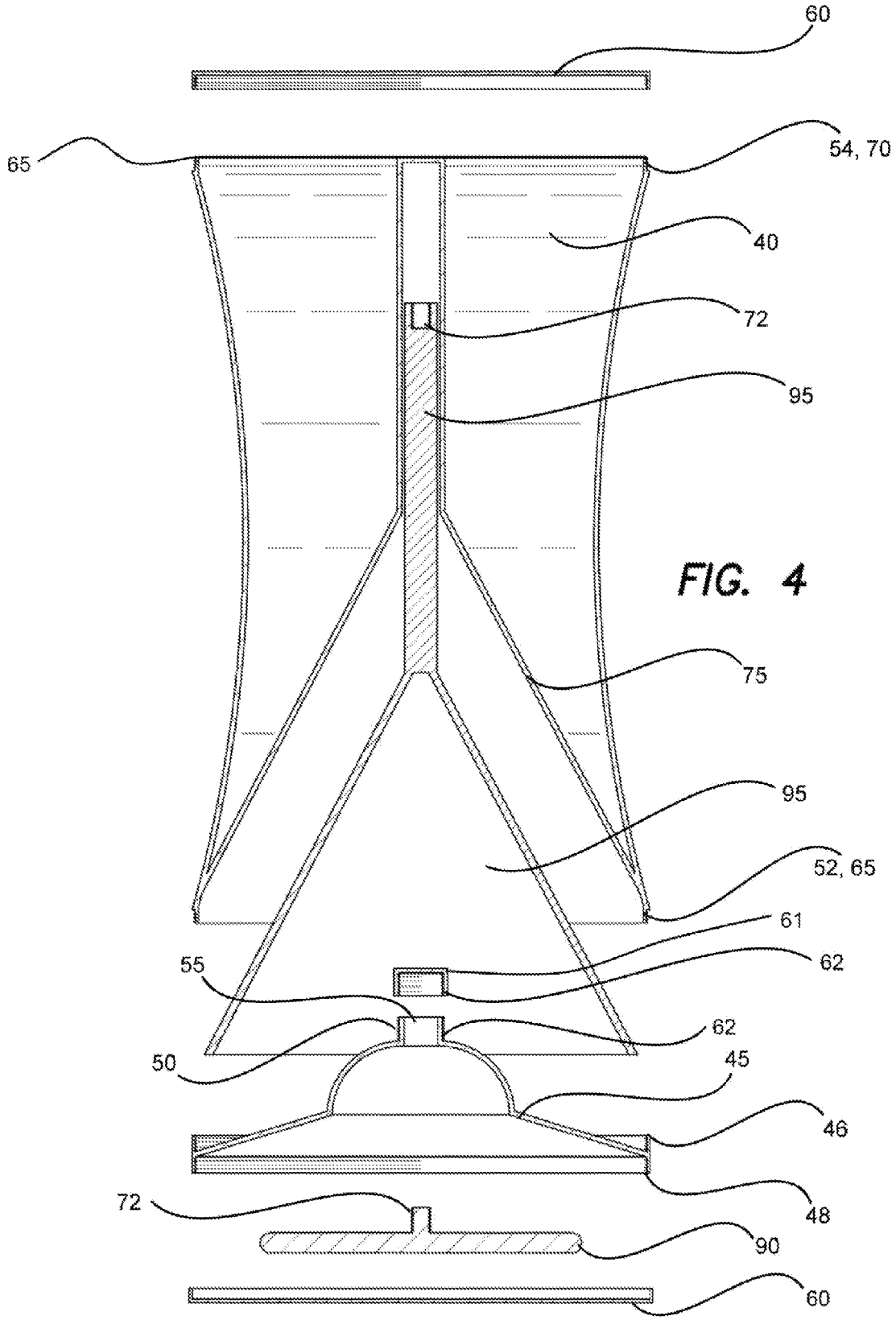
FIG. 4 is and exploded view in cross section of the beverage assembly and mixing kit.
Figure 5:
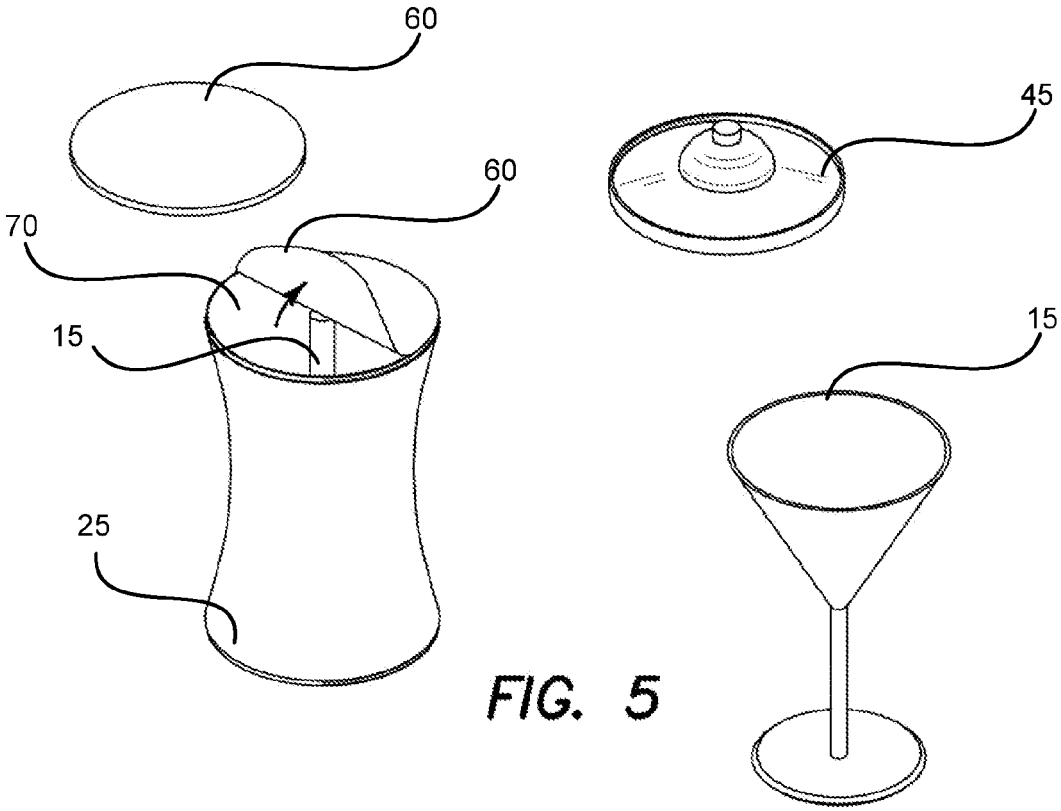
FIG. 5 is a perspective view of the beverage container and the opening of the shaker containing the beverage contents.
Figure 6:
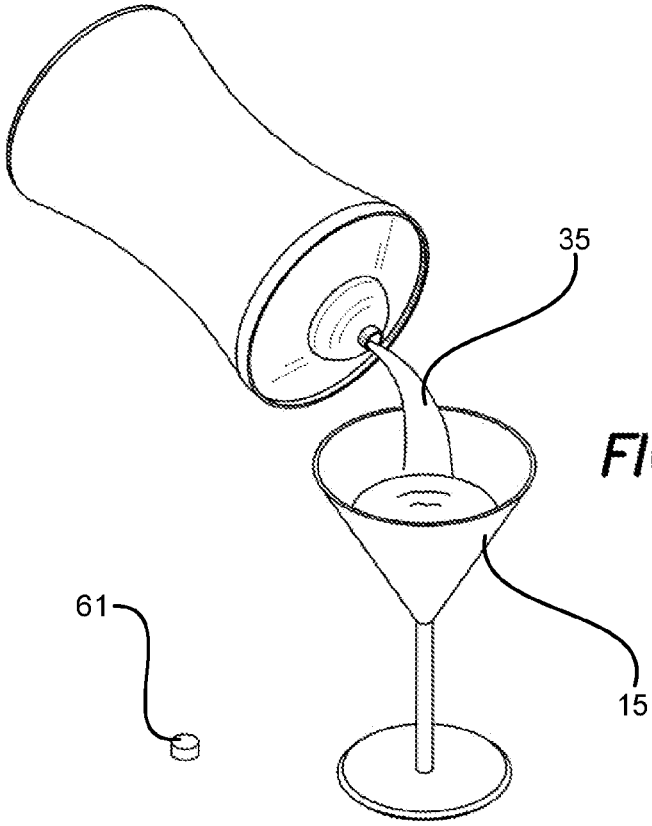
FIG. 6. is a perspective view of the beverage assembly and mixing kit, illustrating the shaker assembled and beverage contents mixed.

(4) In a further variant, the portable beverage assembly kit comprises a lid 45 having two sides and a pour spout 50 disposed on one side of the lid 45. The pour spout 50 has a through hole 55 permitting transfer of liquid through the lid 45. In a transport configuration, as shown in FIGS. 1 and 3, the lid may optionally have two sets of threads 46, 48 configured to screw onto an optional respective set of threads 52, 54 on an end 65 and on an opening 70 of the shaker 25, respectively. Threads 46, 48 are disposed on a ring 56 that extends from an edge of the lid 45 in opposite directions from the edge 58. The threads comprise a mechanism for securing the lid 45 and other contends of the kit, both in the transport configuration of the kit (shown in FIG. 3 for example) and in the serving configuration of the kit (as shown in FIG. 6 for example).

(5) In still another variant, the portable beverage assembly kit comprises a cap 61. The pour spout 50 is configured to receive the cap 61. Optionally, the pour spout and cap 61 are secured via corresponding threads 62.

(6) In yet another variant of the portable beverage assembly kit, the lid is removeably attachable to the shaker on both sides of the lid.

(7) In a variant, the shaker comprises a disassembled shaker, comprising: a pour spout 50 that is detachable from the shaker. An end 65 of the shaker is configured to connect to the pour spout 50 in a manner that orients the pour spout in an inward facing direction inside of the shaker. An opening 70 of the shaker leading to a fluid container 40 is configured to connect to the pour spout 50 in a manner that orients the pour spout 50 in an outward facing direction outside of the shaker.

(8) In another variant, a portable beverage assembly kit 10 has a serving container 15 and beverage ingredients 35, for fast distribution to an end user of the components necessary to construct a beverage and container for serving same. The assembly kit 10 has a beverage container 15 and a shaker 25 configured to store within the shaker 25, the beverage container 15 and the beverage ingredients 35 within two separate compartments 30, 40. A lid 45 for the shaker is connected to the compartment storing the beverage container 30, has a pour spout 50 oriented to an interior of the shaker when the kit is in a transport configuration, for example, as shown in FIGS. 1 and 3. The lid 45 is connected to the compartment 40 storing the beverage ingredients when the kit is assembled in a use configuration, for example, as shown in FIG. 6. Preferably, the walls 75 of the compartment storing the beverage container conforms generally to the shape of the beverage container 15. The compartment 40 storing the beverage ingredients is liquid tight when sealed with a cap 60. Variants of the beverage assembly kit may have beverage containers of varying shapes such as a shot glass shape or a margarita glass shape, for example. Likewise, walls 75 of the compartment storing the beverage container of varying shapes, are configured to conform to the general shape of the beverage container 15. Optionally, walls 85 of the compartment 40 storing the beverage ingredients are configured to conform to the shape of at least part of the beverage container.

(9) In a further variant, the beverage container 15 is a disassembled beverage container configured for drinking directly therefrom, comprising a base 90 and a cup portion 95. The base 90 and the cup portion 95 may optional have corresponding threads 72 as a mechanism to assemble and secure to one another.

(10) In yet another variant of the portable beverage assembly kit, the beverage container 15 is a traditional martini glass, defined as a hollow conical container with an open end and a closed point, the closed point attached at to a stem at a first end, and a base allowing the container to sit upright at a the stem's second end.

(11) In still a further variant of the portable beverage assembly kit, removeable caps 60 are configured to secure enclose ends 65 of the shaker. Optionally, a foil or plastic seal 60 may be pealable to expose the beverage ingredient compartment 40.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A portable beverage assembly kit for distribution to an end user, having a serving container and beverage ingredients, which comprise the components necessary to construct a beverage and container for serving same, comprising:

a disassembled beverage container configured for drinking directly therefrom; and a shaker configured to store within the shaker the disassembled beverage container within a first compartment and the beverage ingredients within a second compartment, separate from the first compartment; and the shaker further comprising:

a first removable lid also comprising a pour spout;

a top end having a rim configured to allow bodily engagement with the removable lid; and a bottom end having a rim configured to allow bodily engagement with said lid, the bottom end leading into the second compartment for storing a beverage;

a second removeable lid configured to securely cover and seal a beverage within the second compartment;

a base for the disassembled beverage container disposed between the first and second removeable lid.

2. The portable beverage assembly kit of claim 1, the first compartment comprises a dry compartment and the second compartment comprises a fluid filled compartment containing the beverage ingredients.

3. The portable beverage assembly kit of claim 2, wherein the dry compartment is shaped to conform to the shape of the beverage container.

4. The portable beverage assembly kit of claim 2, further comprising:

a lid having two sides; and a pour spout disposed on one side of the lid, the pour spout having a through hole permitting transfer of liquid through the lid.

5. The portable beverage assembly kit of claim 4, further comprising a cap, and wherein the pour spout is configured to receive the cap.

6. The portable beverage assembly kit of claim 4, wherein the lid is removeably attachable to the shaker on both sides of the lid.

7. The portable beverage assembly kit of claim 1, wherein the shaker comprises a disassembled shaker, comprising:

a pour spout detachable from the shaker;

an end of the shaker configured to connect to the pour spout in a manner that orients the pour spout in an inward facing direction inside of the shaker; and an opening of the shaker leading to a fluid container configured to connect to the pour spout in a manner that orients the pour spout in an outward facing direction outside of the shaker.

8. A portable beverage assembly kit configured to store a serving container and beverage ingredients therein, for distribution to an end user, the components necessary to construct a beverage and container for serving same, comprising:

a disassembled beverage container; and a shaker configured to store within the shaker the disassembled beverage container within a first compartment and beverage ingredients within a second compartment, separate from the first compartment;

the shaker further comprising a first end and a second end having rims allowing for bodily engagement with a first lid and a second lid;

wherein the first lid for the shaker is connected to the compartment storing the beverage container, having a pour spout oriented to an interior of the shaker when the kit is in a transport configuration, and said first lid is connected to the compartment storing the beverage ingredients when the kit is assembled in a use configuration;

wherein walls of the compartment storing beverage container conforms to the shape of the beverage container;

a second removable lid configured to securely cover and seal a beverage within the second compartment;

wherein the compartment storing beverage ingredients is liquid tight when sealed with the second removable lid;

a base for the disassembled beverage container disposed between the first and second removeable lid.

9. The portable beverage assembly kit of claim 8, wherein the beverage container is a disassembled beverage container configured for drinking directly therefrom, comprising: a cup portion.

10. The portable beverage assembly kit of claim 8, wherein the beverage container is a martini glass.

11. The portable beverage assembly kit of claim 1, wherein the second removable lid is a pealable foil or pealable plastic seal.

12. The portable beverage assembly kit of claim 8, wherein the second removable lid is a pealable foil or pealable plastic seal.

* * * * *